US009153901B2

(12) United States Patent
Yamashita

(10) Patent No.: US 9,153,901 B2
(45) Date of Patent: Oct. 6, 2015

(54) CONNECTOR AND WIRE HARNESS

(71) Applicant: Hitachi Metals, Ltd., Tokyo (JP)

(72) Inventor: Nobuyuki Yamashita, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 109 days.

(21) Appl. No.: 14/012,281

(22) Filed: Aug. 28, 2013

(65) Prior Publication Data

US 2014/0060924 A1 Mar. 6, 2014

(30) Foreign Application Priority Data

Aug. 29, 2012 (JP) ..... 2012-189099

(51) Int. Cl.

| | |
|---|---|
| ***H01R 11/22*** | (2006.01) |
| ***H01R 13/533*** | (2006.01) |
| ***H01R 13/187*** | (2006.01) |
| *H01R 13/11* | (2006.01) |
| *H01R 13/193* | (2006.01) |

(52) U.S. Cl.

CPC ..... *H01R 13/533* (2013.01); *H01R 13/187* (2013.01); *H01R 13/113* (2013.01); *H01R 13/193* (2013.01)

(58) Field of Classification Search

CPC .. H01R 13/58; H01R 13/6335; H01R 13/111; H01R 13/113; H01R 13/187; H01R 13/15; H01R 13/20

USPC ..... 439/449, 482, 483, 845–847, 851, 852

See application file for complete search history.

(56) References Cited

U.S. PATENT DOCUMENTS

| | | | | |
|---|---|---|---|---|
| 6,290,553 | B1 * | 9/2001 | Sato et al. | 439/843 |
| 6,394,858 | B1 * | 5/2002 | Geltsch et al. | 439/852 |
| 7,048,597 | B2 * | 5/2006 | Chen | 439/851 |
| 7,059,921 | B2 * | 6/2006 | Mulot | 439/852 |
| 7,140,927 | B2 * | 11/2006 | Casses et al. | 439/852 |
| 7,252,562 | B1 * | 8/2007 | Chen | 439/852 |

(Continued)

FOREIGN PATENT DOCUMENTS

| | | |
|---|---|---|
| JP | 2001-210418 | 8/2001 |
| JP | 2007-157525 | 6/2007 |
| JP | 2011-040184 | 2/2011 |

OTHER PUBLICATIONS

Japanese Office action dated Aug. 14, 2015 and english translation of notice of reasons for refusal.

*Primary Examiner* — Thanh Tam Le

(74) *Attorney, Agent, or Firm* — Roberts Mlotkowski Safran & Cole P.C.

(57) ABSTRACT

A connector includes a terminal including a connecting portion that is connected to a plate portion formed at an end of another terminal by a fitting, and an elastic member having a lower rigidity than the plate portion and the connecting portion. The connecting portion includes a bottom portion to be in contact with the plate portion and first and second side portions provided upright from both end sides of the bottom portion in a width direction orthogonal to the fitting direction so as to interpose a contact portion with the plate portion therebetween. When the terminal is fitted to the other terminal, the elastic member is interposed between the plate portion and the first and second side portions and elastically deforms and contacts with both side surfaces of the plate portion in the width direction and with the first and second side portions in the elastically deformed state.

7 Claims, 11 Drawing Sheets

(56) References Cited

U.S. PATENT DOCUMENTS 7,465,199 B2 * 12/2008 Osada et al. ..... 439/845
7,481,685 B2 * 1/2009 Fukaya et al. ..... 439/852
7,537,497 B2 * 5/2009 Tyler ..... 439/843

* cited by examiner

32b SECOND INNER SURFACE
320a SECOND LOWER SURFACE

CONNECTOR AND WIRE HARNESS

The present application is based on Japanese patent application No. 2012-189099 filed on Aug. 29, 2012, the entire contents of which are incorporated herein by reference.

BACKGROUND OF THE INVENTION

1. Field of the Invention

The invention relates to a connector in which a contact portion of a male terminal is received in a cylindrical female terminal, and a wire harness which is provided with the connector and a cable.

2. Description of the Related Art

As a conventional box-shaped female terminal fitting into which a male terminal fitting is inserted, a female terminal fitting having a pair of left-and-right embosses formed on inner surfaces of left-and-right side plates of a main body is known (see, e.g., JP-A-2001-210418).

In the female terminal fitting described in JP-A-2001-210418, the pair of left-and-right embosses is formed by inwardly raising the side plates of the female terminal fitting. A clearance is formed between a tab of the male terminal fitting to be inserted into the female terminal fitting and the side plate of the female terminal fitting but the tab of the male terminal fitting is in contact with the embosses of the female terminal fitting. Accordingly, even when the tab wobbles in a widthwise direction thereof due to vibration, etc., generated in a male connector housing having the male terminal fitting housed therein and a female connector housing having the female terminal fitting housed therein, right and left side edges abut against the embosses and it is thus possible to restrict wobbling of the tab in the widthwise direction.

SUMMARY OF THE INVENTION

However, in JP-A-2001-210418, it is necessary to press-fit the male terminal fitting into a narrow gap formed between the embosses inside the female terminal fitting in order to surely restrict the wobbling of the tab by bringing the male terminal fitting into contact with the embosses. At this time, since the male terminal fitting is inserted into the female terminal fitting while pushing apart these embosses, a strong force is required at the time of insertion.

Therefore, it is an object of the invention to provide a connector that allows a male terminal to be easily inserted into a female terminal while suppressing widthwise relative movement of a connecting portion of the female and that of the male terminal, as well as a wire harness using the connector.

(1) According to one embodiment of the invention, a connector comprises:

a terminal comprising a connecting portion that is relatively moved in a direction fitting to another terminal and is connected to a plate portion formed at an end of the other terminal; and an elastic member having a lower rigidity than the plate portion and the connecting portion, wherein the connecting portion comprises a bottom portion to be in contact with the plate portion and first and second side portions provided upright from both end sides of the bottom portion in a width direction orthogonal to the fitting direction so as to interpose a contact portion with the plate portion therebetween, and wherein, when the terminal is fitted to the other terminal, the elastic member is interposed between the plate portion and the first and second side portions, elastically deforms and comes into contact with both side surfaces of the plate portion in the width direction and with the first and second side portions in the elastically deformed state.

In the above embodiment (1) of the invention, the following modifications and changes can be made.

(i) The connecting portion further comprises an upper portion facing the bottom portion and is formed in a cylindrical shape.

(ii) The elastic member comprises a gap between the first and second side portions before the terminal is fitted to the other terminal, and the gap is narrowed by the fitting.

(iii) The elastic member comprises a pair of arm portions to sandwich the plate portion in the width direction and a coupling portion for coupling integrally the pair of arm portions.

(iv) A plurality of convex portions are formed on the pair of arm portions at both end portions in the direction of fitting to the plate portion and at positions facing thereto in the width direction.

(v) A spring member is attached to the connecting portion of the terminal, the spring member being curved so as to press the plate portion against the contact portion of the bottom portion, and wherein an inclined surface is formed on the coupling portion of the elastic member, the inclined surface being formed along the curve of the spring member so as to come into contact with the spring member at the time of fitting to restrict deformation of the spring member.

(2) According to another embodiment of the invention, a wire harness comprises:

the connector according to the above embodiment (1); and an cable comprising a conductive wire and an insulation covering the conductive wire and being connected to the terminal at an end portion of the conductive wire, wherein the conductive wire comprises a plurality of strands twisted together and twist of the plurality of strands is partially unraveled and exposed inside a housing.

Effects of the Invention

According to one embodiment of the invention, a connector can be provided that allows a male terminal to be easily inserted into a female terminal while suppressing widthwise relative movement of a connecting portion of the female and that of the male terminal, as well as a wire harness using the connector.

BRIEF DESCRIPTION OF THE DRAWINGS

Next, the present invention will be explained in more detail in conjunction with appended drawings, wherein:

FIGS. 6A to 6D show a spacer, wherein FIG. 6A is a perspective view, FIG. 6B is a top view, FIG. 6C is a front view and FIG. 6D is a cross sectional view taken on line D-D in FIG. 6A;

FIGS. 8A and 8B are diagrams illustrating a connecting portion of the female terminal as viewed from a bottom portion side, wherein FIG. 8A is a diagram illustrating a state before inserting a plate portion of the male terminal and FIG. 8B is a diagram illustrating a state after inserting the plate portion;

FIGS. 9A and 9B are cross sectional views taken on line B-B in FIG. 1A, wherein FIG. 9A is an enlarged view and FIG. 9B is a diagram illustrating a state in which the male terminal is inserted;

FIGS. 11A to 11C show a spacer in a second embodiment of the invention, wherein FIG. 11A is a perspective view, FIG. 11B is a top view and FIG. 11C is a front view.

DETAILED DESCRIPTION OF THE PREFERRED EMBODIMENTS

First Embodiment

Figure 1:
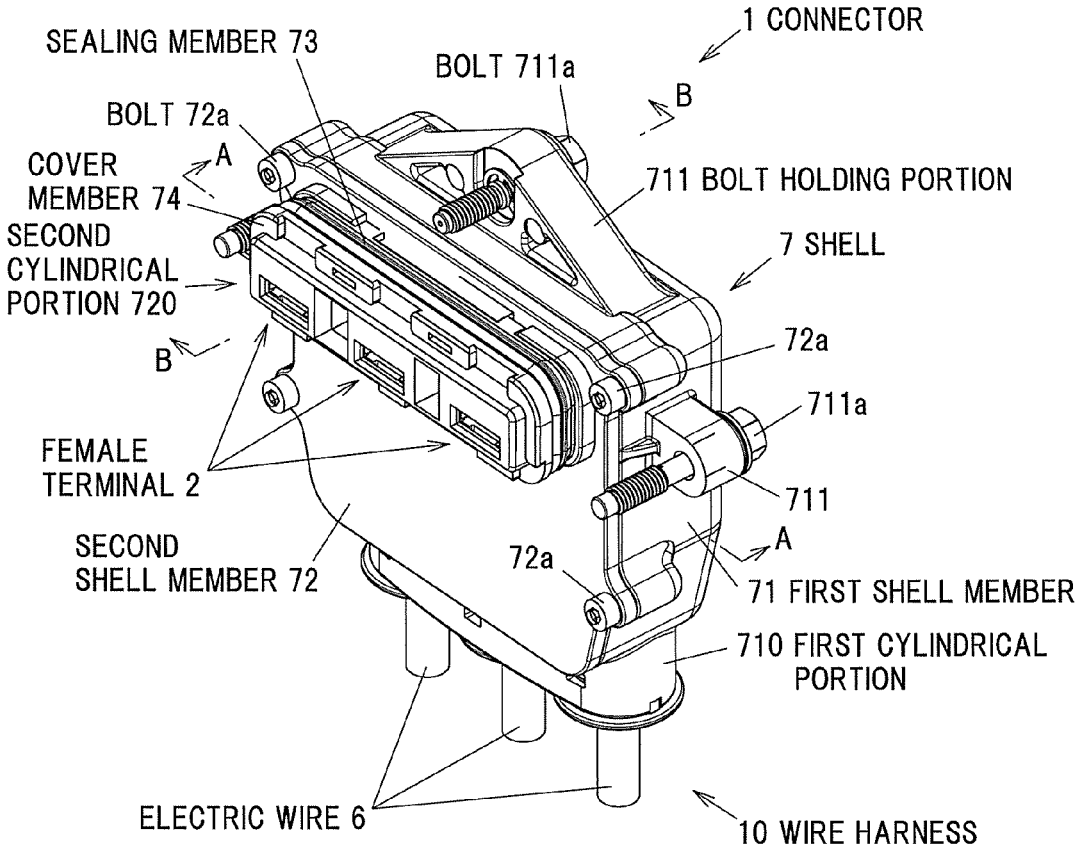
FIG. 1 is a perspective view showing a connector and a wire harness in a first embodiment of the present invention.
Figure 2:
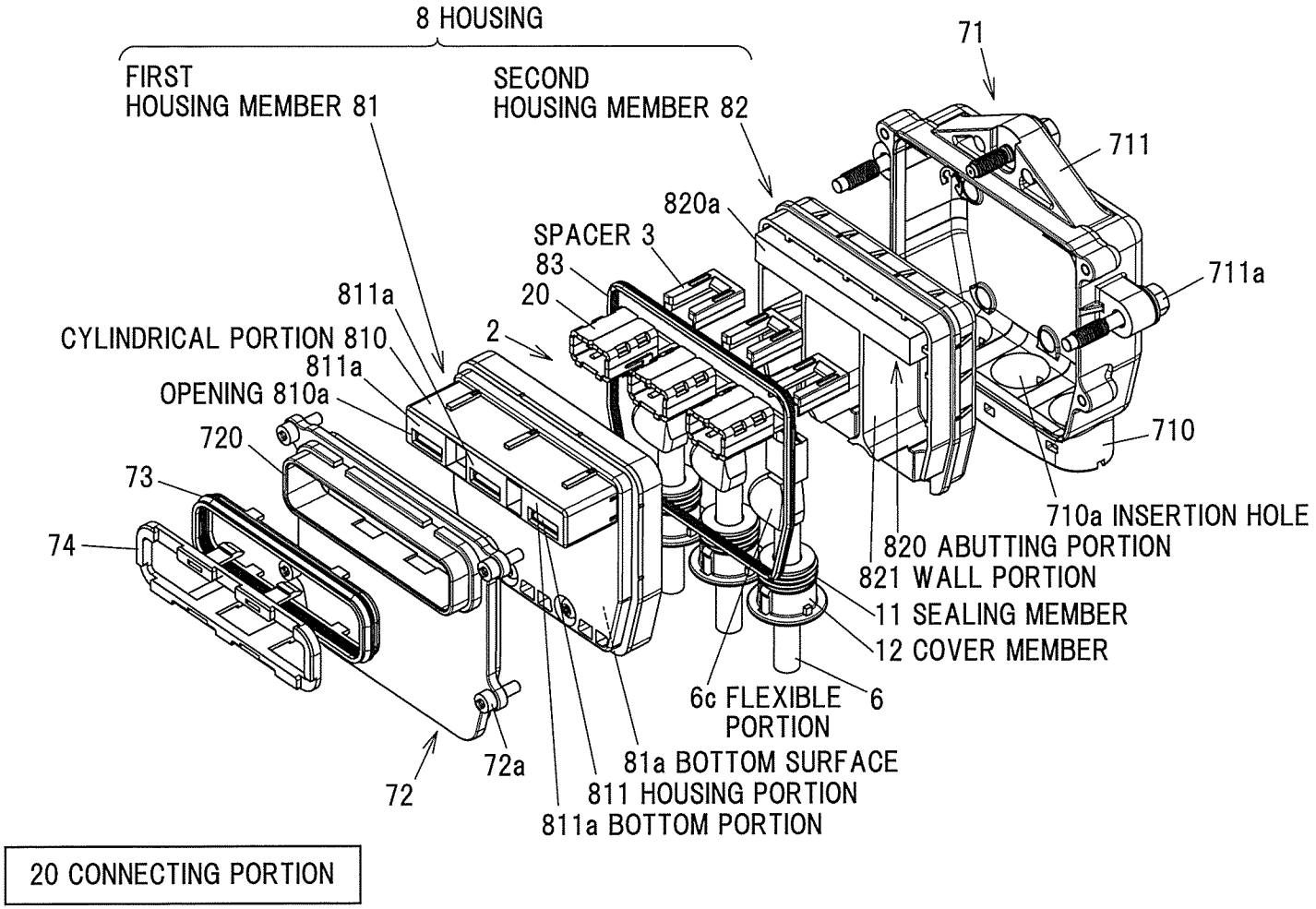
FIG. 2 is an exploded perspective view showing the connector.

FIG. 1 is a perspective view showing a connector 1 and a wire harness 10 in a first embodiment of the invention. FIG. 2 is an exploded perspective view showing the connector 1.

The connector 1 and the wire harness 10 are mounted on, e.g., a vehicle having an electric motor as a driving force for moving the vehicle and is used for connecting the electric motor to an inverter which supplies three-phase AC to the electric motor. In this case, the connector 1 is connected to a connector which is preliminarily fixed to the electric motor or the inverter.

Structure of Wire Harness 10

The wire harness 10 is composed of the connector 1 and three electric wires 6. The connector 1 is provided with female terminals 2 to be connected to below-described male terminals, a housing 8 for housing the female terminals 2 and holding the electric wires 6, and a metal shell 7 for housing the female terminals 2 and portions of the electric wires 6.

The shell 7 is composed of a first shell member 71 and a second shell member 72. The first shell member 71 and the second shell member 72 are formed of, e.g., conductive metal such as aluminum. In addition, the shell 7 is configured that the first shell member 71 houses the three female terminals 2 and an opening of the first shell member 71 is covered with the plate-like second shell member 72.

The first shell member 71 is fixed to the second shell member 72 by plural (four in the present embodiment) bolts 72*a*. In addition, three bolt holding portions 711 which protrude outward are formed on the first shell member 71 and each bolt holding portion 711 rotatably holds a bolt 711*a* used for fixing the connector 1 to a device such as an inverter.

A second cylindrical portion 720 for housing a connecting portion 20 of the female terminal 2 is formed on the second shell member 72. An annular sealing member 73 is held on an outer peripheral surface of the second cylindrical portion 720. A resin cover member 74 is locked to a front end face of the second cylindrical portion 720.

The housing 8 is composed of a first housing member 81 and a second housing member 82 which face each other with the three electric wires 6 interposed therebetween. The first housing member 81 and the second housing member 82 are formed of, e.g., an insulating resin such as PBT (polybutylene terephthalate), etc. The electric wires 6 are sandwiched and held between the first housing member 81 and the second housing member 82.

A cylindrical portion 810 which has three housing portions 811 for housing the respective connecting portions 20 of the three female terminals 2 are formed on the first housing member 81. The three housing portions 811 are lined in a row. In addition, each housing portion 811 is formed in a bottomed cylindrical shape extending opposite to the second housing member 82 along a direction orthogonal to a planar bottom surface 81*a* facing the second housing member 82 such that a bottom portion 811*a* which is to face a below-described male terminal 4 is formed at a front end portion. A slit-like opening 810*a* for inserting a plate portion 40 of the below-described male terminal 4 is formed on each bottom portion 811*a*.

An abutting portion 820 is provided upright on the second housing member 82 so as to be orthogonal to a bottom surface which faces the bottom surface 81*a* of the first housing member 81. A front end face 820*a* of the abutting portion 820 faces one end face of the connecting portion 20 of the female terminal 2 (an end face opposite to the opening 810*a*). Then, the abutting portion 820 restricts movement of the female terminal 2 in one direction (a fitting direction of the below-described male terminal 4) by abutment of the front end face 820*a* against the connecting portion 20. In addition, the front end face 820*a* of the abutting portion 820 abuts against a below-described spacer 3, thereby preventing the spacer 3 from slipping out of the connecting portion 20 of the female terminal 2.

In addition, two wall portions 821 partitioning a housing space for the three female terminals 2 into three are formed on the second housing member 82 so as to be continuous with the abutting portion 820. Portions of the electric wires 6, below-described coupling portions 21 and wire connecting portions 22 of the female terminals 2 are respectively housed in the three partitioned spaces. The wall portion 821 is formed to extend in a direction orthogonal to a longitudinal direction of the abutting portion 820.

A first cylindrical portion 710 for inserting the three electric wires 6 is formed on the first shell member 71. Three insertion holes 710*a* for respectively inserting the three electric wires 6 are formed on the first cylindrical portion 710. An annular sealing member 11 for sealing a gap between an outer peripheral surface of the electric wire 6 and an inner peripheral surface of the insertion hole 710*a* is housed in each insertion holes 710*a*. Each sealing member 11 is prevented from slipping out by a cover member 12 which is locked to the first cylindrical portion 710.

The spacer 3 as elastic member (or resilient member) is housed in the connecting portion 20 of the female terminal 2. The spacer 3 is formed of, e.g., an insulating resin such as PBT (polybutylene terephthalate), etc. The spacer 3 will be described in detail later.

Assembly Procedure of Connector 1 and Wire Harness 10

Next, an example of an assembly procedure of the connector 1 and the wire harness 10 will be described in reference to FIG. 2.

For assembling the connector 1, firstly, the second housing member 82 is assembled to the first shell member 71. Next, the female terminal 2 is connected to the electric wire 6 in which a flexible portion 6*c* is formed by unraveling a conductive wire 60 to increase flexibility. Then, the below-described spacer 3 is inserted into the connecting portion 20 of the female terminal 2. The female terminal 2, to which the electric wire 6 is connected and in which the spacer 3 is inserted into the connecting portion 20, is inserted into each of the three housing portions 811 of the first housing member 81. Note that, an annular sealing member 83 is preliminarily attached to the first housing member 81.

The electric wire 6 is passed from an end portion opposite to the female terminal 2 through the insertion hole 710*a* of the first shell member 71 and the first housing member 81 is then fitted to the second housing member 82. After that, the second shell member 72 is fixed to the first shell member 71 by the bolt 72*a*. Note that, the sealing member 73 and the cover member 74 are preliminarily attached to the cylindrical portion 720 of the second shell member 72. Lastly, the sealing member 11 is received in the insertion hole 710*a* of the first shell member 71 and is locked to the cylindrical portion 710 by the cover member 12, thereby completing the assembly of the connector 1.

Figure 3:
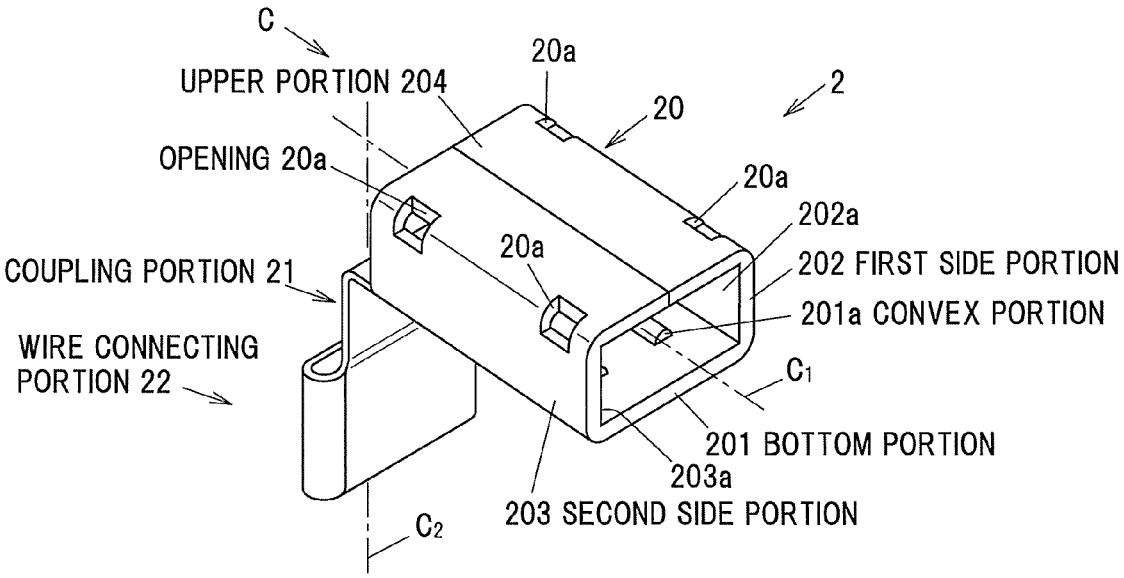
FIG. 3 is a perspective view showing a female terminal.
Figure 4:
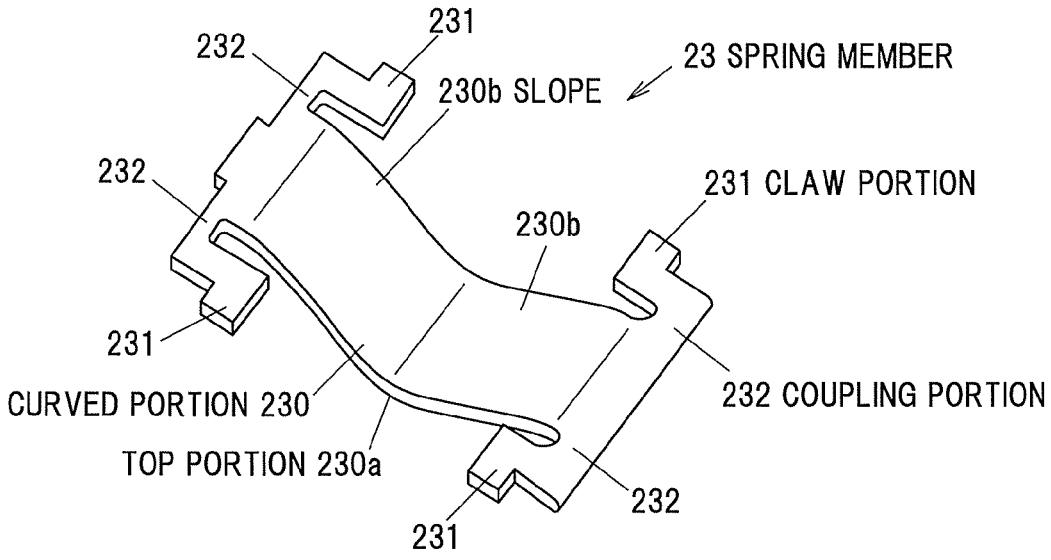
FIG. 4 is a perspective view showing a spring member.

FIG. 3 is a perspective view showing the female terminal 2. FIG. 4 is a perspective view showing a spring member 23.

Structure of Female Terminal 2

As shown in FIG. 3, the female terminal 2 has the connecting portion 20 for fitting the male terminal 4 therein at one end and the wire connecting portion 22 to be connected to a front end portion of the electric wire 6 at another end, and the connecting portion 20 is coupled to the wire connecting portion 22 by the coupling portion 21. As a material of the female terminal 2, it is possible to use, e.g., conductive materials such as carbon steel, stainless steel, copper and copper alloy. Alternatively, the surface of the female terminal 2 may be plated with tin, etc.

The connecting portion 20 has a cylinder shape into which the male terminal 4 is inserted, and is formed along the fitting direction of the male terminal 4. The connecting portion 20 is formed to have a rectangular cross sectional shape of which four sides are composed of a bottom portion 201, a first side portion 202, a second side portion 203 and a upper portion 204. The bottom portion 201, the first side portion 202, the second side portion 203 and the upper portion 204 are each formed in a plate-like shape, the bottom portion 201 faces the upper portion 204, the bottom portion 201 is integrally coupled to the first side portion 202 and the second side portion 203, and the upper portion 204 is integrally coupled to the first side portion 202 and the second side portion 203.

In addition, four openings 20*a* for respectively locking four claw portions 231 of the below-described spring member 23 are formed on the connecting portion 20 at corners formed between the upper portion 204 and the first side portion 202 and between the upper portion 204 and the second side portion 203. In addition, a pair of convex portions 201*a* extending along a longitudinal direction inside the connecting portion 20 is formed on the bottom portion 201. The pair of convex portions 201*a* is formed, as contact portions with the male terminal 4, on a surface of the bottom portion 201 facing the upper portion 204. The first side portion 202 and the second side portion 203 are provided upright from both end sides of the bottom portion 201 in a width direction orthogonal to the fitting direction of the male terminal 4 so as to interpose the pair of convex portions 201*a* therebetween.

The wire connecting portion 22 has a flat-oval tubular shape and is crimped to the front end portion of the electric wire 6 by, e.g., caulking. The female terminal 2 is formed so that a center axis $C_1$ of the connecting portion 20 and a center axis $C_2$ of the wire connecting portion 22 are orthogonal to each other. That is, the female terminal 2 is formed so that the connecting portion 20 is formed along the fitting direction of the male terminal 4 and the wire connecting portion 22 is formed to extend in a direction crossing the fitting direction of the male terminal 4.

As shown in FIG. 4, the spring member 23 integrally includes a curved portion 230 formed to be moderately curved toward the convex portions 201*a* as the contact portions with the plate portion 40 of the male terminal 4, four claw portions 231 to be locked into the openings 20*a* of the female terminal 2 and coupling portions 232 for coupling the curved portion 230 to the claw portions 231. The curved portion 230 further includes a top portion 230*a* at the middle in a curving direction and a pair of slopes 230*b* inclined in directions opposite to each other with the top portion 230*a* interposed therebetween. As a material of the spring member 23, it is possible to use, e.g., metal materials such as stainless steel, phosphor bronze and beryllium copper, etc., or non-metal materials such as rubber, etc.

Structure of Male Terminal 4

Figure 5:
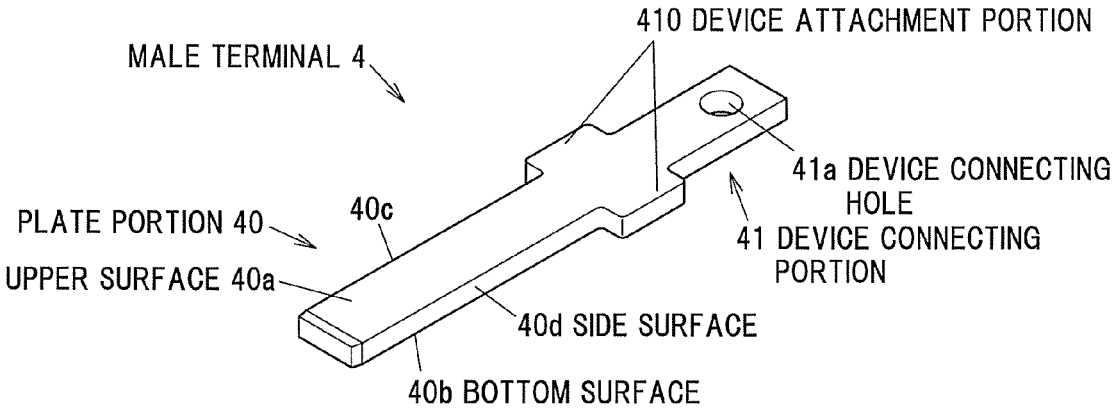
FIG. 5 is a perspective view showing a male terminal.

FIG. 5 is a perspective view showing the male terminal 4.

On the male terminal 4, the plate-like plate portion 40 to be inserted into the connecting portion 20 of the female terminal 2 is provided at one end and a device connecting portion 41 to be electrically connected to an internal wiring of a device such as an inverter is provided at an another end. The plate portion 40 and the device connecting portion 41 are formed from a single plate. The plate portion 40 has a upper surface 40*a* to face the upper portion 204 of the connecting portion 20 when inserted into the connecting portion 20 of the female terminal 2, a bottom surface 40*b* to face the bottom portion 201, a side surface 40*c* to face the first side portion 202 and a side surface 40*d* to face the second side portion 203.

When the plate portion 40 is inserted into the connecting portion 20, the top portion 230*a* of the spring member 23 of the female terminal 2 comes into contact with the upper surface 40*a* and the plate portion 40 is then pressed against the convex portions 201*a*, which causes the convex portions 201*a* come into contact with the bottom surface 40*b*. As a result, the male terminal 4 is electrically connected to the female terminal 2.

The device connecting portion 41 is fitted to a device by device attachment portions 410 protruding outward from the side surfaces 40*c* and 40*d* and is fixed to the device by a bolt inserted through a device connecting hole 41*a*.

Structure of Spacer 3

Figure 6A:
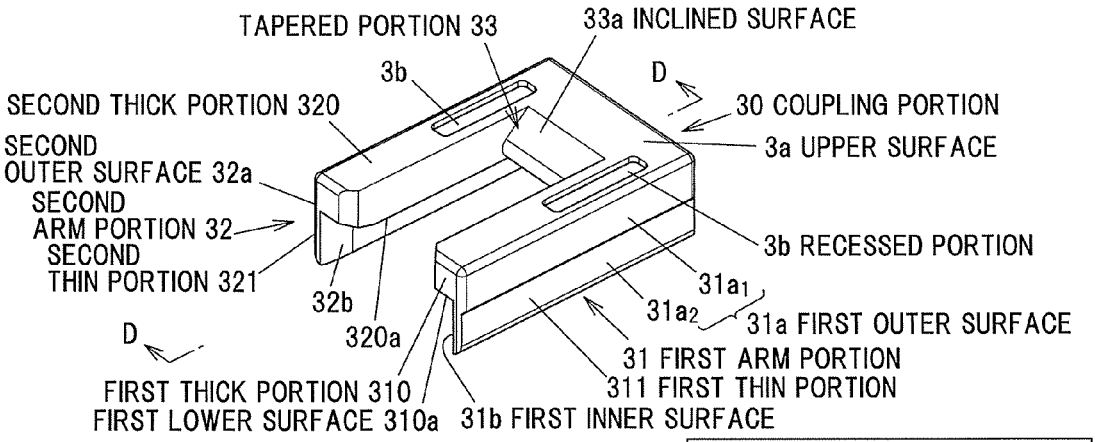
Figure 6B:
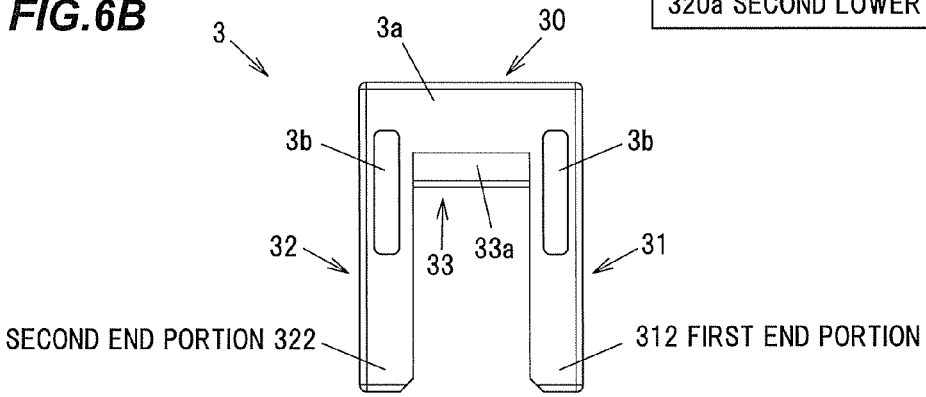
Figure 6C:
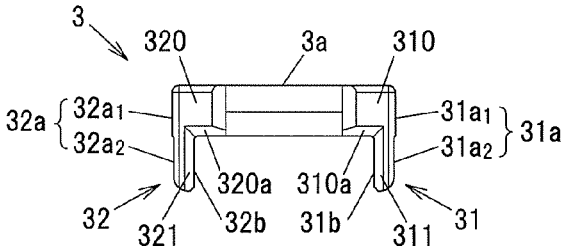
Figure 6D:
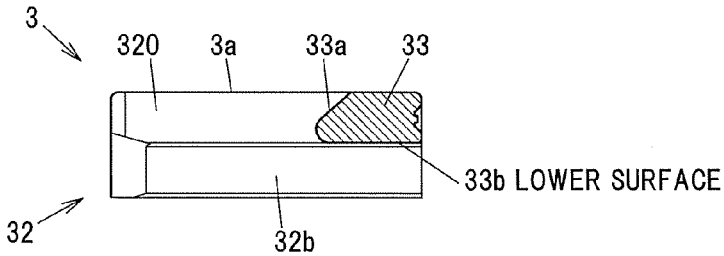

FIGS. 6A to 6D show the spacer 3, wherein FIG. 6A is a perspective view, FIG. 6B is a top view, FIG. 6C is a front view and FIG. 6D is a cross sectional view taken on line D-D in FIG. 6A.

The spacer 3, which becomes interposed between the plate portion 40 of the male terminal 4 and the first side portion 202 and the second side portion 203 of the female terminal 2 by fitting the male terminal 4 to the female terminal 2, elastically deforms in a width direction (a width direction along the bottom portion 201 of the female terminal 2 which is orthogonal to the direction of fitting to the male terminal 4) and comes into contact with the both side surfaces 40*c* and 40*d* of the plate portion 40 in the width direction and with the first side portion 202 and the second side portion 203 in the elastically deformed state.

As shown in FIGS. 6A to 6D, the spacer 3 integrally includes a first arm portion 31 and a second arm portion 32 which extends in parallel to each other along a direction (herein the direction being referred to as "a longitudinal direction of the spacer 3") of fitting the male terminal 4 to the female terminal 2 and a coupling portion 30 for coupling the first arm portion 31 and the second arm portion 32. The coupling portion 30 is formed in a direction (the direction being referred to as an orthogonal direction in the present embodiment) crossing the longitudinal direction of the spacer 3. The spacer 3 is inserted into the connecting portion 20 of the female terminal 2 from a first end portion 312 of the first arm portion 31 and a second end portion 322 of the second arm portion 32 (front end portions on the opposite side to the coupling portion 30) along an arrow-C direction shown in FIG. 3 which is parallel to the first arm portion 31 and the second arm portion 32, thereby inserting the spacer 3 into the female terminal 2. When the spacer 3 is inserted into the connecting portion 20 of the female terminal 2, an inner surface 204*a* of the upper portion 204 of the connecting portion 20 is opposite an upper surface 3*a* of the spacer 3.

The first arm portion 31 is composed of a first thick portion 310 and a first thin portion 311 which have different thicknesses in the orthogonal direction of the spacer 3. Likewise, the second arm portion 32 is composed of a second thick portion 320 and a second thin portion 321 which have different thicknesses in the orthogonal direction of the spacer 3. The first thin portion 311 and the second thin portion 321 are formed thinner in the orthogonal direction of the spacer 3 than the first thick portion 310 and the second thick portion 320. The first thin portion 311 and the second thin portion 321, and the first thick portion 310 and the second thick portion 320 are opposite to each other in the orthogonal direction of the spacer 3. The first thick portion 310 and the second thick portion 320 are formed on the upper surface 3*a* side of the spacer 3 above the first thin portion 311 and the second thin portion 321. Accordingly, a distance between the first thin portion 311 and the second thin portion 321 is longer than that between the first thick portion 310 and the second thick portion 320 located on the upper surface 3*a* side of the spacer 3.

A tapered portion 33 having an inclined surface 33*a* inclined with respect to the arrow-C direction is formed on the coupling portion 30 between the first thick portion 310 and the second thick portion 320. In addition, recessed portions 3*b* extending in the direction of fitting the male terminal 4 to the female terminal 2 are formed on the upper surface 3*a* of the first arm portion 31 and the second arm portion 32 on the coupling portion 30 side.

A first outer surface 31*a* of the first arm portion 31 on the opposite side to the second arm portion 32 is composed of a first thick portion-outer surface $\mathbf{31}a_1$ on the upper surface 3*a* side and a first thin portion-outer surface $\mathbf{31}a_2$ sandwiching the first thick portion-outer surface $\mathbf{31}a_1$ between itself the upper surface 3*a*. The first thin portion-outer surface $\mathbf{31}a_2$ is offset inward from and parallel to the first thick portion-outer surface $\mathbf{31}a_1$. In the first embodiment, the first thick portion-outer surface $\mathbf{31}a_1$ is formed on the outer side of the first thick portion 310 and the first thin portion-outer surface $\mathbf{31}a_2$ is formed on the outer side of the first thin portion 311.

Likewise, a second outer surface 32*a* of the second arm portion 32 on the opposite side to the first arm portion 31 is composed of a second thick portion-outer surface $\mathbf{32}a_1$ on the upper surface 3*a* side and a second thin portion-outer surface $\mathbf{32}a_2$ sandwiching the second thick portion-outer surface $\mathbf{32}a_1$ between itself the upper surface 3*a*. The second thin portion-outer surface $\mathbf{32}a_2$ is offset inward from and parallel to the second thick portion-outer surface $\mathbf{32}a_1$. In the first embodiment, the second thick portion-outer surface $\mathbf{32}a_1$ is formed on the outer side of the second thick portion 320 and the second thin portion-outer surface $\mathbf{32}a_2$ is formed on the outer side of the second thin portion 321.

A first lower surface 310*a* and a second lower surface 320*a* which are parallel to the arrow-C direction are formed on surfaces of the first thick portion 310 and the second thick portion 320 on the opposite side to the upper surface 3*a*. In addition, a first inner surface 31*b* and a second inner surface 32*b* which are orthogonal to the first lower surface 310*a* and the second lower surface 320*a* are formed on the opposite sides (inside) to the first thin portion-outer surface $\mathbf{31}a_2$ of the first arm portion 31 and the second thin portion-outer surface $\mathbf{32}a_2$ of the second arm portion 32. In the first embodiment, the first inner surface 31*b* and the second inner surface 32*b* are formed on the facing surfaces of the first thin portion 311 and the second thin portion 321. A space formed between the first inner surface 31*b* and the second inner surface 32*b* is a housing space for housing the male terminal 4, as described later.

Figure 7A:
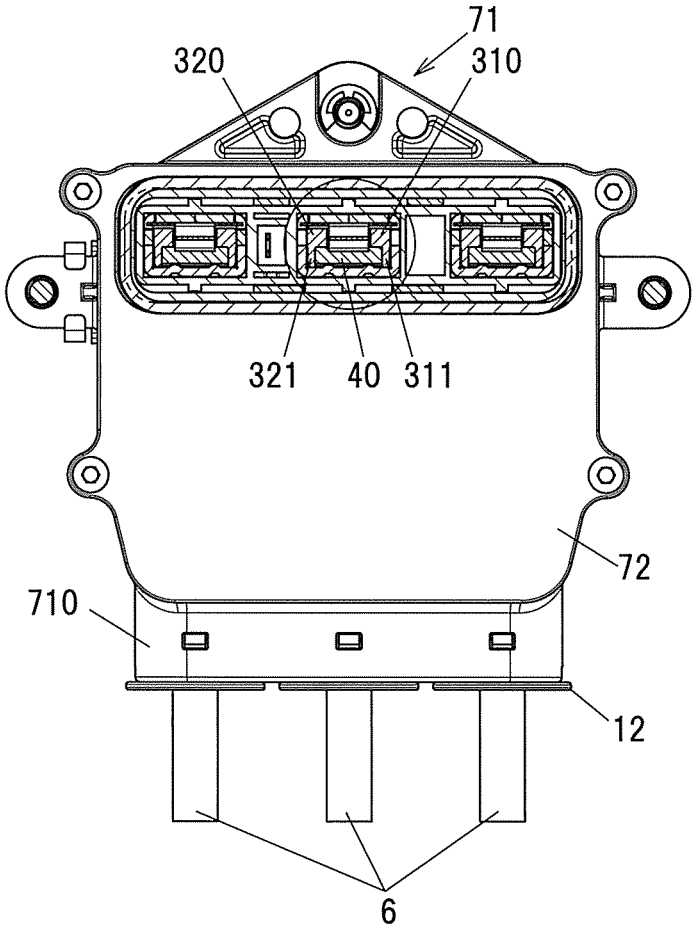
FIG. 7A is a cross sectional view taken on line A-A in FIG. 1A
Figure 7B:
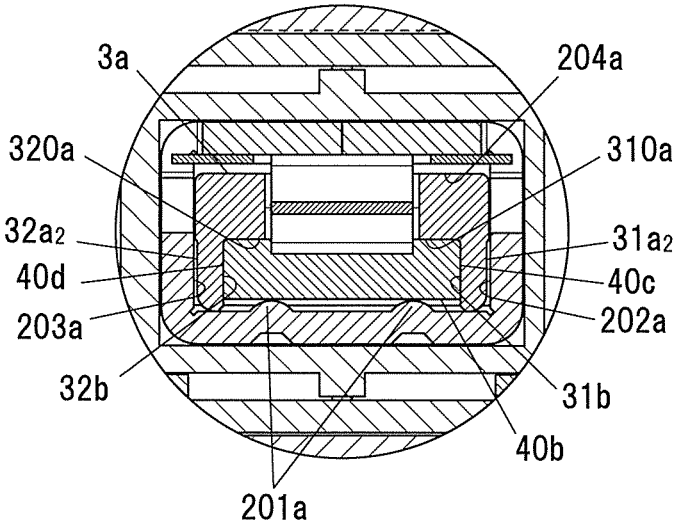
FIG. 7B is an enlarged view of FIG. 7A.

FIGS. 7A and 7B show a state in which the male terminal 4 is fitted to the female terminal 2, wherein FIG. 7A is a cross sectional view taken on line A-A in FIG. 1A and FIG. 7B is an enlarged view of FIG. 7A.

As shown in FIGS. 7A and 7B, elastic deformation occurs such that the first arm portion 31 and the second arm portion 32 are pushed away by the male terminal 4 when the male terminal 4 is fitted to the female terminal 2, and in this elastically deformed state, an inner surface 202*a* of the first side portion 202 of the female terminal 2 comes into contact with the first thick portion-outer surface $\mathbf{31}a_1$ on the first outer surface 31*a* of the first arm portion 31 of the spacer 3, and also, an inner surface 203*a* of the second side portion 203 of the female terminal 2 comes into contact with the second thick portion-outer surface $\mathbf{32}a_1$ on the second outer surface 32*a* of the second arm portion 32 of the spacer 3. In addition, the inner surface 204*a* of the upper portion 204 of the female terminal 2 comes into contact with the upper surface 3*a* of the spacer 3. In other words, the insertion of the spacer 3 into the connecting portion 20 of the female terminal 2 creates a state in which the inner surfaces 202*a*, 203*a* and 204*a* of the connecting portion 20 of the female terminal 2 are in contact with the first outer surface 31*a*, the second outer surface 32*a* and the upper surface 3*a* of the spacer 3.

Meanwhile, when the plate portion 40 of the male terminal 4 is inserted between the first arm portion 31 and the second arm portion 32, the first inner surface 31*b* of the first arm portion 31 and the second inner surface 32*b* of the second arm portion 32 come into contact with the side surfaces 40*c* and 40*d* of the plate portion 40, and also, the first lower surface 310*a* of the first thick portion 310 and the second lower surface 320*a* of the second thick portion 320 come into contact with both widthwise end portions of the plate portion 40 on the upper surface 40*a*. In addition, the convex portions 201*a* of the connecting portion 20 of the female terminal 2 come into contact with the bottom surface 40*b* of the plate portion 40.

Figure 8A:
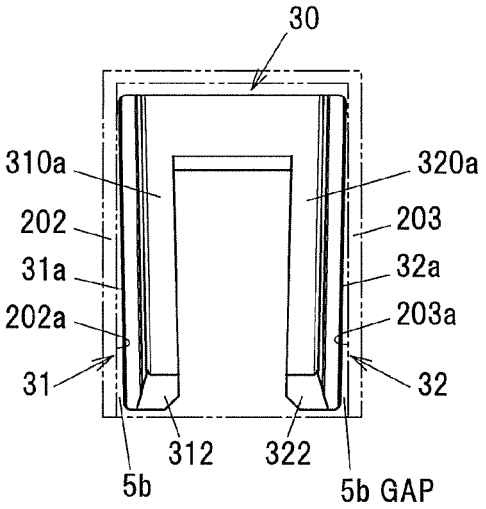
Figure 8B:
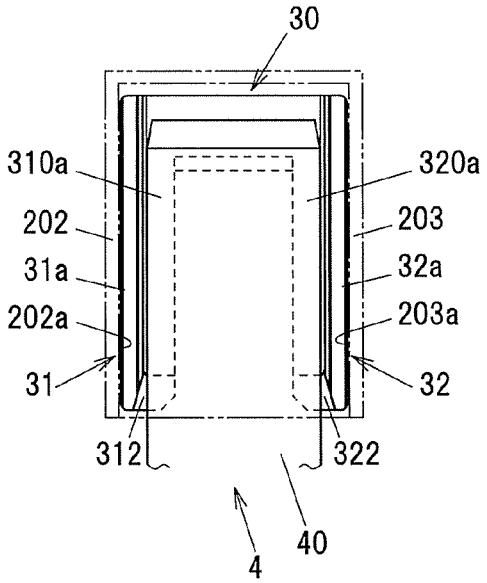

FIGS. 8A and 8B are diagrams illustrating the connecting portion 20 of the female terminal 2 as viewed from the bottom portion 201 side, wherein FIG. 8A is a diagram illustrating a state before inserting the plate portion 40 of the male terminal 4 and FIG. 8B is a diagram illustrating a state after inserting the plate portion 40. It should be noted that the connecting portion 20 is indicated by a two-dot chain line and a gap 5*b* is exaggeratingly depicted for the purpose of the explanation.

In the state before the plate portion 40 of the male terminal 4 is inserted into the connecting portion 20 of the female terminal 2, the gaps 5*b* are formed between the spacer 3 and the connecting portion 20, i.e., respectively between the first outer surface 31*a* of the first arm portion 31 and the inner surface 202*a* of the first side portion 202 and between the second outer surface 32*a* of the second arm portion 32 and the inner surface 203*a* of the second side portion 203. The plate portion 40 of the male terminal 4 is inserted into the connecting portion 20 of the female terminal 2 so as to outwardly push away the first end portion 312 of the first arm portion 31 and the second end portion 322 of the second arm portion 32 of the spacer 3.

Therefore, when the plate portion 40 of the male terminal 4 is fitted to the connecting portion 20 of the female terminal 2, the first thick portion-outer surface $\mathbf{31}a_1$ of the first arm portion 31 is in contact with the inner surface 202*a* of the first side portion 202 of the female terminal 2 and, at the same time, the second thick portion-outer surface $\mathbf{32}a_1$ of the second arm portion 32 of the spacer 3 is in contact with the inner surface 203*a* of the second side portion 203 of the female terminal 2. In addition, the gap 5*b* between the first thin portion-outer surface 31$a_2$ of the first arm portion 31 and the inner surface 202*a* of the first side portion 202 of the female terminal 2 and the gap 5*b* between the second thin portion-outer surface 32$a_2$ of the second arm portion 32 and the inner surface 203*a* of the second side portion 203 of the female terminal 2 become narrower than before fitting the plate portion 40 of the male terminal 4 to the female terminal 2.

Figure 9A:
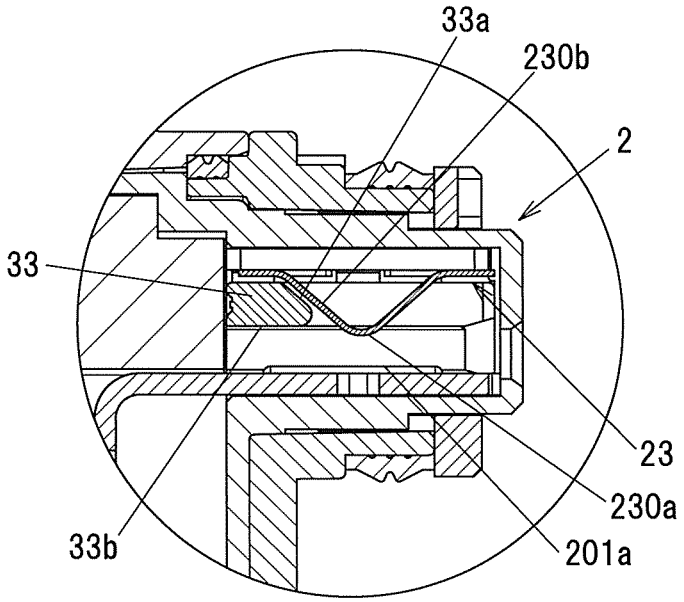
Figure 9B:
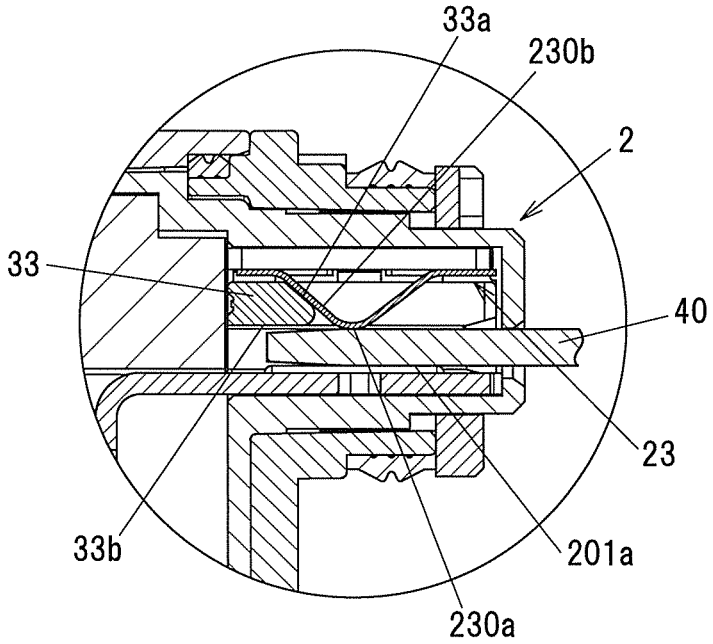

FIGS. 9A and 9B are cross sectional views taken on line B-B in FIG. 1A, wherein FIG. 9A is an enlarged view and FIG. 9B is a diagram illustrating a state in which the plate portion 40 of the male terminal 4 is inserted.

As shown in FIG. 9A, the inclined surface 33*a* of the tapered portion 33 of the spacer 3 is formed along the slope 230*b* of the spring member 23 of the female terminal 2. In the state before fitting the male terminal 4 to the female terminal 2, a gap is formed between the inclined surface 33*a* of the tapered portion 33 and the slope 230*b* of the spring member 23.

As shown in FIG. 9B, when the plate portion 40 of the male terminal 4 is inserted into the connecting portion 20 of the female terminal 2, the spring member 23 is elastically deformed due to a frictional force with the male terminal 4 and is pressed toward the tapered portion along an insertion direction of the male terminal 4. At this time, abutment of the slope 230*b* of the spring member 23 against the tapered portion 33 of the spacer 3 suppresses further deformation of the spring member 23, thereby preventing plastic deformation of the spring member 23.

Figure 10:
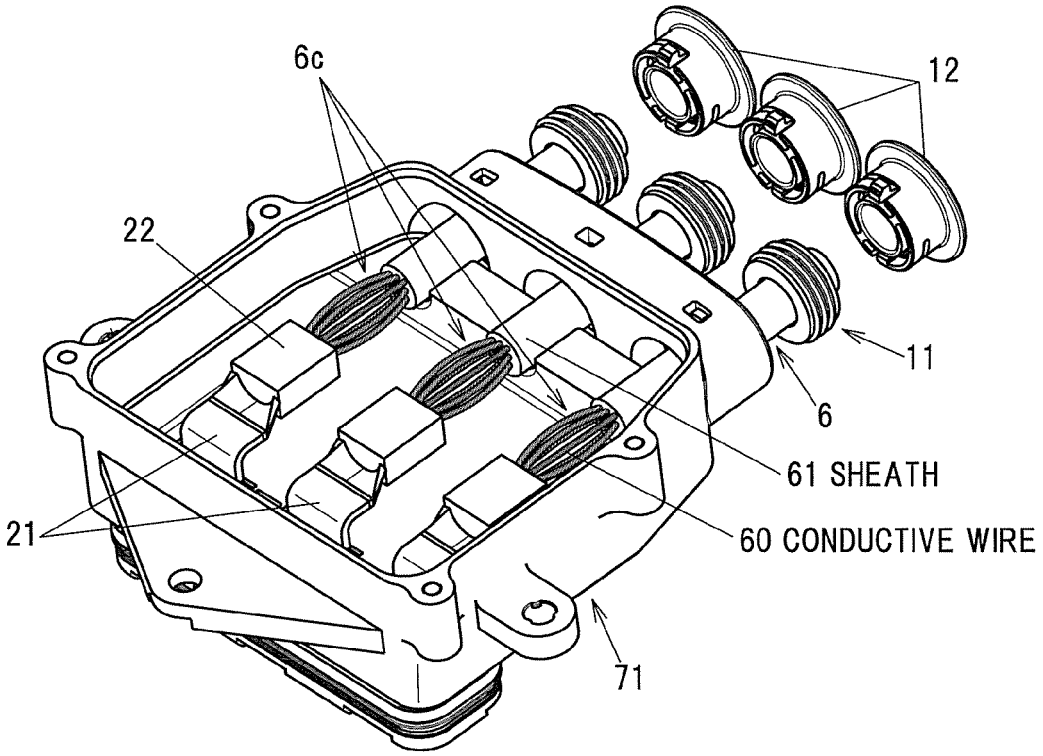
FIG. 10 is a perspective view showing the inside of the back side of the connector.

FIG. 10 is a perspective view showing the inside of the back side of the connector 1. It should be noted that the illustration of the bottom surface of the first shell member 71 is omitted in order to explain the internal structure.

The electric wire 6 has the conductive wire 60 and a sheath 61 provided around the conductive wire 60. The conductive wire 60 is a stranded wire (parent strand) formed by twisting plural conductor strands together to initially form a child strand and then further twisting plural child strands together.

The wire holding portion of the first housing member 81 and the wire holding portion of the second housing member 82 hold an outer periphery of the sheath 61 of the electric wire 6. In addition, the sheath 61 is removed on a tip side beyond the portion held by the wire holding portions to expose the conductive wire 60.

In the electric wire 6, the flexible portion 6*c* having flexibility improved by unraveling the twist of the conductive wire 60 is formed between the wire connecting portion 22 of the female terminal 2 and the wire holding portion. The outer diameter of the flexible portion 6*c* is expanded by unraveling the twist thereof (at least a portion of the parent strand of the parent and child strands). This facilitates movement of the connecting portion 20 of the female terminal 2 along the male terminal 4. On the other hand, since the three conductive wires 60 are uncovered inside the connector 1, it is necessary to pay attention so that short-circuit does not occur between the conductive wires 60.

Functions and Effects of the Embodiment

Following functions and effects are obtained by the embodiment.

(1) It is possible to suppress widthwise wobbling of the plate portion 40 of the male terminal 4 by interposing the spacer 3 between the plate portion 40 of the male terminal 4 and the connecting portion 20 of the female terminal 2. In addition, since the spacer 3 elastically deforms, it is possible to easily insert the plate portion 40 of the male terminal 4 into the connecting portion 20 of the female terminal 2.

(2) Since there are the gaps 5*b* respectively between the spacer 3 and the first side portion 202 and between the spacer 3 and the second side portion 203 of the connecting portion 20 of the female terminal 2 in the state before fitting the male terminal 4 to the female terminal 2, the plate portion 40 of the male terminal 4 is inserted while expanding the spacer 3. This allows easy insertion and also improves tight contact between the male terminal 4 and the spacer 3.

(3) The spacer 3 is formed of one member by integrally coupling the first arm portion 31 to the second arm portion 32 by the coupling portion 30, which facilitates handling during assembly.

(4) A force which largely deforms the spring member 23 of the female terminal 2 may be applied by a frictional force with the plate portion 40 when the plate portion 40 of the male terminal 4 is inserted the connecting portion 20 of the female terminal 2, however, in the first embodiment, it is possible to prevent plastic deformation of the spring member 23 by forming the tapered portion 33 on the spacer 3.

(5) Since the spacer 3 formed of a resin is interposed between the plate portion 40 of the male terminal 4 and the connecting portion 20 of the female terminal 2, there is no risk that sliding movement of the male terminal 4 and the female terminal 2 produces and scatters metal fragments inside the connector 1. As a result, short-circuit does not occur between the three conductive wires 60 even though the outer diameter thereof is expanded by unraveling the twist.

(6) The spacer 3 has the first arm portion 31 provided with the first thick portion 310 and the first thin portion 311 and the second arm portion 32 provided with the second thick portion 320 and the second thin portion 321, and the plate portion 40 of the male terminal 4 is inserted between the first thin portion 311 and the second thin portion 321. Accordingly, it is possible to ensure support rigidity of the male terminal 4 by the spacer 3 while suppressing width expansion of the connecting portion 20 of the female terminal 2. In other words, by interposing the first thin portion 311 and the second thin portion 321 between the plate portion 40 of the male terminal 4 and the first side portion 202 and the second side portion 203 of the connecting portion 20 of the female terminal 2, it is possible to suppress the width expansion of the connecting portion 20 and the support rigidity provided by the first thin portion 311 and the second thin portion 321 can be ensured by the first thick portion 310 and the second thick portion 320. In addition, since the first thick portion 310 and the second thick portion 320 are arranged between the first side portion 202 and the second side portion 203 of the connecting portion 20 and the spring member 23, it is not necessary to increase the size of the connecting portion 20 in order to house the first thick portion 310 and the second thick portion 320.

Second Embodiment

Figure 11A:
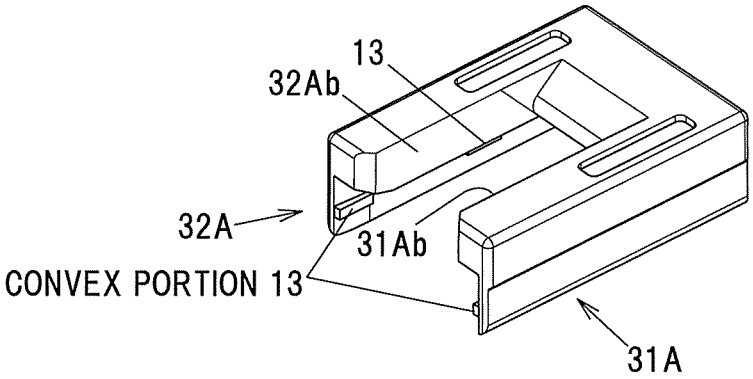
Figure 11B:
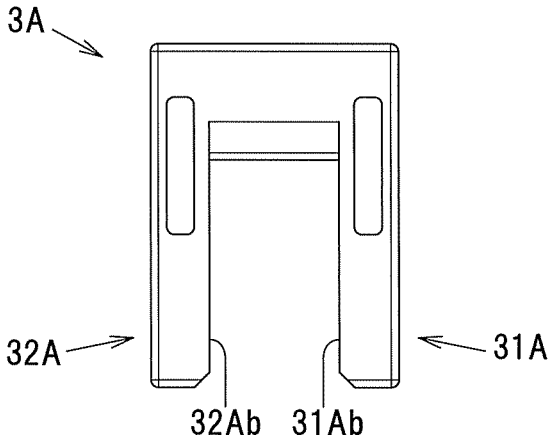
Figure 11C:
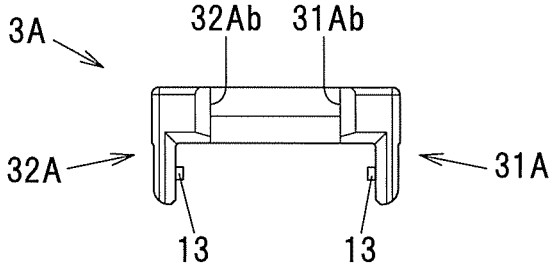

FIGS. 11A to 11C show a spacer 3A in a second embodiment of the invention, wherein FIG. 11A is a perspective view, FIG. 11B is a top view and FIG. 11C is a front view.

In the spacer 3A of the second embodiment, a shape of a first arm portion 31A and a second arm portion 32A is different from that of the first arm portion 31 and the second arm portion 32 in the first embodiment and the remaining configuration of the spacer 3A is the same as the spacer 3 in the first embodiment. Therefore, members having the same functions are denoted by the same reference numerals and the overlapping explanation will be omitted.

On a first inner surface 31Ab of the first arm portion 31A and a second inner surface 32Ab of the second arm portion 32A of the spacer 3A, convex portions 13 protruding toward the plate portion 40 of the male terminal 4 are formed on the first end portion 312A and second end portion 322A sides and also on the coupling portion 30 side. In other words, two convex portions 13 are formed on the first inner surface 31Ab of the first arm portion 31A and another two convex portions 13 are formed on the second inner surface 32Ab of the second arm portion 32A. The four convex portions 13 are closely in contact with the side surfaces 40*c* and 40*d* of the plate portion 40 of the male terminal 4.

In the second embodiment, the following functions and effects are achieved in addition to the same functions and effects as (1) to (6) described in the first embodiment.

By providing the convex portions 13 on the first inner surface 31Ab of the first arm portion 31A and the second inner surface 32Ab of the second arm portion 32A of the spacer 3A, close contact with the plate portion 40 of the male terminal 4 is further enhanced and it is possible to encourage suppression of backlash.

Although the embodiments of the invention has been described, the invention according to claims is not to be limited to the above-mentioned embodiments. Further, please note that all combinations of the features described in the embodiments are not necessary to solve the problem of the invention.

Although the case of having, e.g., three female terminals 2 has been described in the embodiments, the number of the female terminals 2 is not limited.

In addition, although the conductive wire 60 of the electric wire 6 is formed of a stranded wire, it is not limited thereto and the conductive wire 60 may be a solid wire. In this case, the flexible portion 6*c* can be formed by, e.g., curving a conductive wire formed of a solid wire inside the connector 1.

In addition, the connecting portion 20 of the female terminal 2 does not necessarily need to be bent at a right angle with respect to the electric wire 6. In other words, the connecting portion 20 may be attached along an extending direction of the electric wire 6.

In addition, the shape of the male terminal 4 is not specifically limited as long as it is a plate shape.

In addition, the spacer 3 may be provided on the male terminal 4 so as to sandwich the plate portion 40 of the male terminal 4 in a width direction thereof.

In addition, the spacer 3 may be composed of two members, first and second spacer portions. In this case, the first spacer portion is provided on one of side portions of the plate portion 40 of the male terminal 4, and the second spacer portion is provided inside the connecting portion 20 of the female terminal 2 so as to be arranged opposite to the first spacer portion when the male terminal 4 is fitter to the female terminal 2.

In addition, the shape of the connecting portion 20 of the female terminal 2 does not need to be a cylindrical shape and may be a shape in which the first side portion 202 and the second side portion 203 are formed at one and another widthwise end portions of the bottom portion 201 without having the upper portion 204 (a squared U-shape). In this case, the first side portion 202 and the second side portion 203 are formed on both widthwise ends of the bottom portion 201 or in the vicinity thereof.

What is claimed is:

1. A connector, comprising:

a terminal comprising a connecting portion that is relatively moved in a direction fitting to another terminal and is connected to a plate portion formed at an end of another terminal; and an elastic member having a lower rigidity than the plate portion and the connecting portion, wherein the connecting portion comprises a bottom portion to be in contact with the plate portion and first and second side portions provided upright from both end sides of the bottom portion in a width direction orthogonal to the fitting direction so as to interpose a contact portion with the plate portion therebetween, and wherein, when the terminal is fitted to the another terminal, the elastic member is interposed between the plate portion and the first and second side portions, elastically deforms and comes into contact with both side surfaces of the plate portion in the width direction and with the first and second side portions in the elastically deformed state.

2. The connector according to claim 1, wherein the connecting portion further comprises an upper portion facing the bottom portion and is formed in a cylindrical shape.

3. The connector according to claim 1, wherein a gap exists between the elastic member and the first and second side portions before the terminal is fitted to the another terminal, and the gap is narrowed by the fitting.

4. The connector according to claim 1, wherein the elastic member comprises a pair of arm portions to sandwich the plate portion in the width direction and a coupling portion for coupling integrally the pair of arm portions.

5. The connector according to claim 4, wherein a plurality of recessed portions are formed on the pair of arm portions at both end portions in the direction of fitting to the plate portion and at positions facing thereto in the width direction.

6. The connector according to claim 4, wherein a spring member is attached to the connecting portion of the terminal, the spring member having a curved portion so as to press the plate portion against the contact portion of the bottom portion, and wherein an inclined surface is formed on the coupling portion of the elastic member, the inclined surface being formed along the curved portion of the spring member so as to come into contact with the spring member at the time of fitting to restrict deformation of the spring member.

7. A wire harness, comprising: the connector according to claim 1; and a cable comprising a conductive wire and an insulation covering the conductive wire and being connected to the terminal at an end portion of the conductive wire, wherein the conductive wire comprises a plurality of strands twisted together and twist of the plurality of strands is partially unraveled and exposed inside a housing.

* * * * *